US009032695B2

(12) United States Patent
Häring et al.

(10) Patent No.: US 9,032,695 B2
(45) Date of Patent: May 19, 2015

(54) LIFTING DEVICE FOR CHAMBER CONVEYOR BELT MACHINE

(75) Inventors: Rainer Häring, Lauben (DE); Klaus Rothermel, Unteregg (DE)

(73) Assignee: MULTIVAC SEPP HAGGENMULLER GMBH & CO. KG, Wolfertschwenden (DE)

( * ) Notice: Subject to any disclaimer, the term of this patent is extended or adjusted under 35 U.S.C. 154(b) by 1086 days.

(21) Appl. No.: 13/074,553

(22) Filed: Mar. 29, 2011

(65) Prior Publication Data

US 2011/0247303 A1 Oct. 13, 2011

(30) Foreign Application Priority Data

Apr. 7, 2010 (DE) ..... 10 2010 013 889

(51) Int. Cl.
*B65B 31/02* (2006.01)
*B65B 65/00* (2006.01)
*B65B 65/02* (2006.01)

(52) U.S. Cl.
CPC ..... *B65B 31/024* (2013.01); *B65B 65/00* (2013.01); *B65B 31/028* (2013.01); *B65B 65/02* (2013.01)

(58) Field of Classification Search
CPC .... B65B 31/02; B65B 31/021; B65B 31/022; B65B 31/024; B65B 31/025; B65B 31/028; B65B 7/162; B65B 7/164; B65B 65/00; B65B 65/02; B65B 9/04; B65B 11/52; B65B 25/067; B65B 47/02; B65B 61/06; B29C 51/04; B29C 51/10; B29C 51/38; B30B 1/14
USPC ..... 53/432, 433, 478, 510, 511, 329.3, 453, 53/559, 393; 100/269.11, 270–272; 425/388
See application file for complete search history.

(56) References Cited

U.S. PATENT DOCUMENTS

| | | | | | |
|---|---|---|---|---|---|
| 1,007,792 | A | * | 11/1911 | Orton | 72/432 |
| 1,819,704 | A | * | 8/1931 | Friz | 100/270 |
| 2,599,591 | A | * | 6/1952 | Spiller et al. | 83/379 |
| 3,033,737 | A | * | 5/1962 | Peters | 156/486 |
| 3,397,507 | A | * | 8/1968 | Myers | 53/511 |
| 3,508,373 | A | * | 4/1970 | Robinson, Jr | 53/408 |
| 3,597,897 | A | * | 8/1971 | Gerard | 53/84 |
| 3,818,574 | A | * | 6/1974 | Reid et al. | 29/243.57 |
| 3,857,222 | A | * | 12/1974 | Grebe | 53/511 |

(Continued)

FOREIGN PATENT DOCUMENTS

| | | |
|---|---|---|
| CN | 2371118 Y | 3/2000 |
| CN | 2709317 Y | 7/2005 |

(Continued)

OTHER PUBLICATIONS

EPO machine translation of EP 569937, retrieved from espacenet.com on Jul. 25, 2014, 7 pages.*

(Continued)

*Primary Examiner* — Stephen F Gerrity
(74) *Attorney, Agent, or Firm* — Husch Blackwell LLP

(57) ABSTRACT

A lifting device for the movement of a chamber upper part of a chamber conveyor belt machine, the lifting device having first and second lifting mechanisms. The first lifting mechanism may be driven by a motorized drive, and the second lifting mechanism may be driven by an adjusting cylinder. The lifting device may further include a connection element for coupling the two lifting mechanisms.

15 Claims, 3 Drawing Sheets

(56) References Cited

U.S. PATENT DOCUMENTS

| | | | | | |
|---|---|---|---|---|---|
| 3,910,008 | A | * | 10/1975 | Johnson | 53/509 |
| 3,958,394 | A | * | 5/1976 | Mahaffy et al. | 53/511 |
| 4,069,643 | A | * | 1/1978 | Young et al. | 53/434 |
| 4,070,896 | A | * | 1/1978 | Heitner | 72/389.5 |
| 4,253,364 | A | * | 3/1981 | Kiefer et al. | 83/217 |
| 4,316,712 | A | * | 2/1982 | Medendorp | 425/388 |
| 4,344,270 | A | * | 8/1982 | Andersson | 53/511 |
| 4,361,432 | A | * | 11/1982 | McMaster et al. | 65/104 |
| 4,515,546 | A | * | 5/1985 | Medwed | 425/195 |
| 4,747,250 | A | * | 5/1988 | Rossi | 53/511 |
| 4,926,671 | A | * | 5/1990 | Hill | 72/389.3 |
| 5,088,268 | A | * | 2/1992 | Gunter | 53/86 |
| 6,085,497 | A | * | 7/2000 | Natterer | 53/559 |
| 6,305,149 | B1 | * | 10/2001 | Gorlich et al. | 53/478 |
| 2005/0178090 | A1 | | 8/2005 | Koke et al. | |
| 2009/0241469 | A1 | * | 10/2009 | Moessnang et al. | 53/209 |
| 2009/0260320 | A1 | | 10/2009 | Miller et al. | |

FOREIGN PATENT DOCUMENTS

| | | | |
|---|---|---|---|
| DE | 4216210 | A1 | 11/1993 |
| EP | 0 569 937 | A1 | 11/1993 |
| EP | 2 110 330 | A1 | 10/2009 |
| EP | 2110330 | A1 | 10/2009 |

OTHER PUBLICATIONS

Chinese Office Action dated Aug. 1, 2012, Applicant Multivac Sepp Haggenmüller GmbH & Co. KG, Application No. 201110086737.6, 14 pages including translation.

Extended European Search Report Dated May 25, 2011, Applicant MULTIVAC Sepp Haggenmuller GmbH & Co KG, Application No. 11002355.3-2308, 5 Pages.

German Patent Office Action Dated Dec. 10, 2010, Applicant MULTIVAC Sepp Haggenmuller GmbH & Co. KG, Application No. 10 2010 013 889.4-27, 3 Pages.

* cited by examiner

LIFTING DEVICE FOR CHAMBER CONVEYOR BELT MACHINE

CROSS-REFERENCE TO RELATED APPLICATION

This application claims the benefit of German Application No. 102010013889.4, filed Apr. 7, 2010, which is hereby incorporated by reference in its entirety.

TECHNICAL FIELD

The present disclosure relates to a device for lifting a chamber upper part of a chamber machine, as well as to a method of lifting a chamber upper part.

BACKGROUND

Chamber conveyor belt machines find their intended use in the sealing of bags that have previously been filled with products and provided on a feeding conveyor belt. These bags are automatically fed to a chamber of the chamber conveyor belt machine by means of this feeding conveyor belt. This chamber is formed by the cover (later also referred to as the chamber upper part) and the machine table. The interior of the chamber formed in this way is evacuated in order to achieve as little residual oxygen in the bag as possible; this particularly plays a crucial role in the minimum durability in the case of foods. The bags are subsequently given an airtight seal by means of sealing, the chamber is vented, and the cover is moved upwards in order to open the chamber. A conveyor belt conveys the bags out of the chamber before the feeding conveyor belt introduces additional new bags into the chamber.

Such a chamber conveyor belt machine is also known from DE 102008015689 A1. In the case of this chamber conveyor belt machine, the cover is connected on one side to a lifting system for lifting and lowering the cover, and has the following dimensions: 1000 mm long and 700 mm wide. In the case of a chamber conveyor belt machine that requires a much greater extension of up to 1800 mm in the conveying direction and 900 mm in the width, which means a cover with larger dimensions, the lifting mechanism of the cover disclosed in DE 102008015689 A1 is no longer possible due to the greater weight of the cover. In order to seal correspondingly larger products or more products in the chamber, the weight of the cover is too great to still hold this on one side and move it. The demand for larger products additionally leads to an increased need for the path of the vertical movement of the cover.

SUMMARY

An object of the present disclosure is to provide a device and a method for operating a chamber conveyor belt machine in which the described problem can be solved.

In the case of the device according to the present disclosure for the movement of a chamber upper part of a chamber conveyor belt machine by means of a multipart lifting mechanism and a motorized drive, a connection element is provided by means of which a first lifting mechanism, which is driven by means of the motorized drive, is coupled to a second lifting mechanism, whereby an adjusting cylinder acted upon by fluid is provided at the second lifting mechanism. In this way, it is possible to implement the first motorized drive efficiently and economically in terms of energy consumption.

The motorized drive can preferably be implemented as a non-self-locking drive motor and be blocked in any position by means of a stopping brake.

This motorized drive can be correspondingly smaller dimensioned due to the support of the motorized drive by the adjusting cylinder when the heavy chamber upper part is lifted. Reduced output leads to lower energy consumption and also to lower manufacturing costs.

At the same time, the first lifting mechanism can be driven upwards by means of the motorized drive and the second lifting mechanism can be driven upwards by means of the adjusting cylinder, in each case in the vertical direction upwards, because the maximally required power is present for this.

Air is advantageously used as the fluid, firstly, because pneumatic cylinders are economical and, secondly, for example, because oil is undesirable in the production area of food companies.

In order to avoid compensating for the advantage of the motorized drive that is favorable in terms of energy by the support of the pneumatic cylinder with additional compressed air consumption, preferably a connection point of the pneumatic cylinder is connected to a pressurizing agent container. This now closed system consumes no compressed air when it is 100% sealed.

The air in the pressurizing agent container is preferably compressed during the lowering movement of the chamber upper part via the pneumatic cylinder and the lifting mechanism, and consequently there results pressure of approximately 4-8 bar. During the lifting movement, the pneumatic cylinder supports the motorized drive with the pressure present in the pressurizing agent container, while at the same time the pressure continuously reduces to a lower pressure level.

Instead of a single pneumatic cylinder, it is also possible to deploy a plurality of cylinders or gas-pressurized springs.

This cylinder is, for example, connected to a lever that in turn is itself permanently attached to the shaft of the second lifting mechanism in order to transfer the force of the cylinder to the shaft.

Levers are conveniently mounted to the shafts of the first and second lifting mechanisms, whereby these levers are connected by the connection element in such a way that by this means, forces can be transferred from one shaft to the other and a synchronous movement of the two lifting mechanisms and movement of the chamber upper part results and consequently the loads on the mechanism and guides are uniformly distributed and consequently act gently on the entire mechanical system.

In the case of the method according to the present disclosure, the cylinder for the lifting work of the motorized drive acts in a supporting manner on the first lifting mechanism by means of a connection element, by means of which the forces can be transferred from one lifting mechanism to the other lifting mechanism.

The cylinder acts in a supporting manner during the lifting of the chamber upper part while at the same time, the maximum pressure in the pressurizing agent container drops, and can act in a braking or cushioning manner during the lowering of the chamber upper part, because in this case, the volume in the cylinder, line and pressurizing agent container is compressed at the end of the movement up to a maximum pressure. This corresponds to the position of the closed chamber for evacuating and sealing the bags.

The motorized drive and the cylinder are preferably designed in such a way that the output of the motor and the support of the cylinder are sufficient for the entire movement for lifting the chamber upper part. During the lowering, the weight of the chamber upper part must achieve compression of the fluid, with the motor taking over the control of the movement profile.

The two lifting mechanisms, which lie opposite each other, can be arranged in the conveying direction on the feeding and removal side or on the right and left sides. Likewise conceivable is a variant with more than four lifting rods or guides for the chamber upper part.

In the following, an advantageous embodiment of the present disclosure is described in more detail with reference to the below drawings.

DETAILED DESCRIPTION

Components that are the same in the figures are given the same reference numbers throughout.

Figure 1:
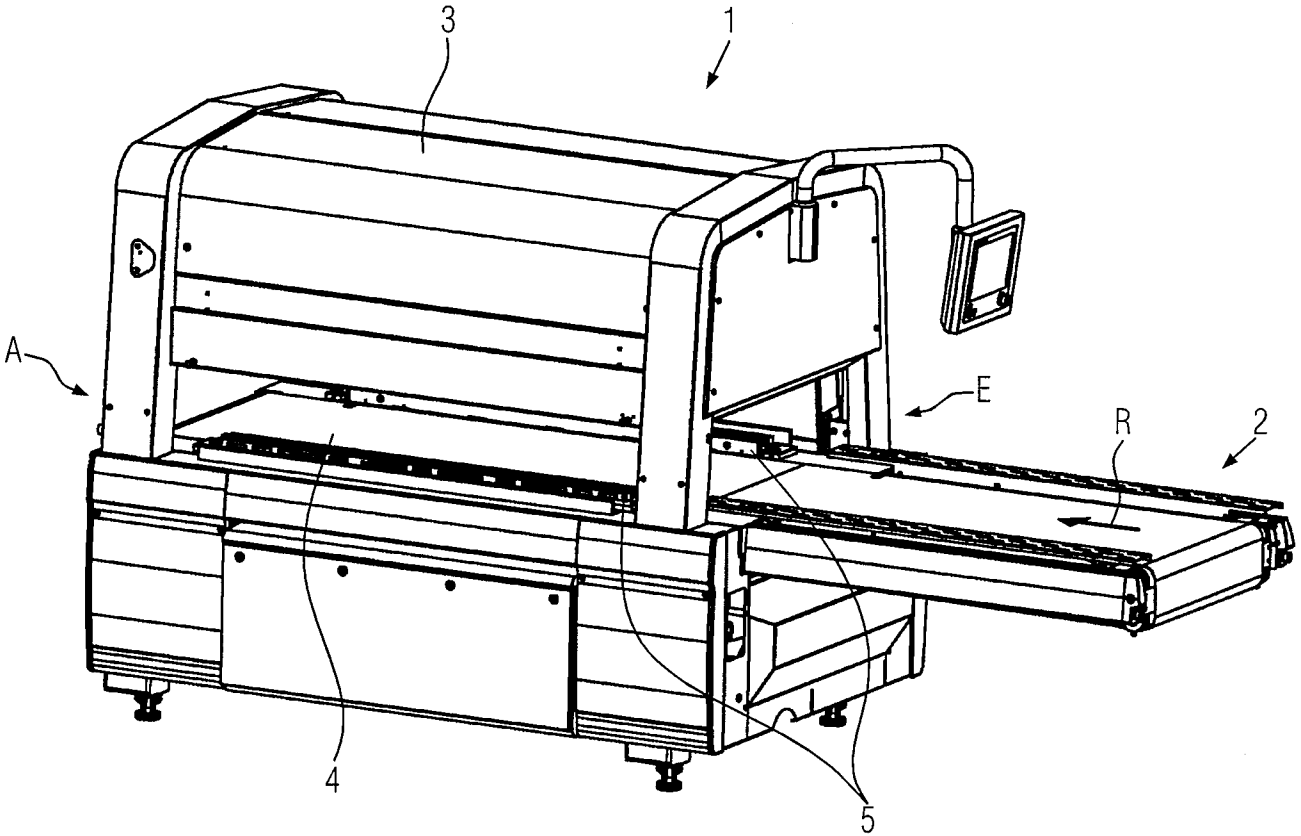
FIG. 1 is a perspective view of an embodiment of a chamber conveyor belt machine.

FIG. 1 shows an embodiment of a chamber conveyor belt machine 1 with a feeding conveyor belt 2 on to which the bags filled with product, which are not shown, are placed. The chamber conveyor belt machine has a conveying direction R, an introduction side E and a removal side A. In its lowered position, which is not shown, the chamber upper part 3 forms a closed chamber with the machine table 4, whereby this chamber is implemented in a manner that allows it to be evacuated.

Sealing bars 5 that are in accordance with the state of the art are located in the chamber, whereby these sealing bars provide the bags with an air-tight seal by means of the sealing seam that is generated.

Figure 2:
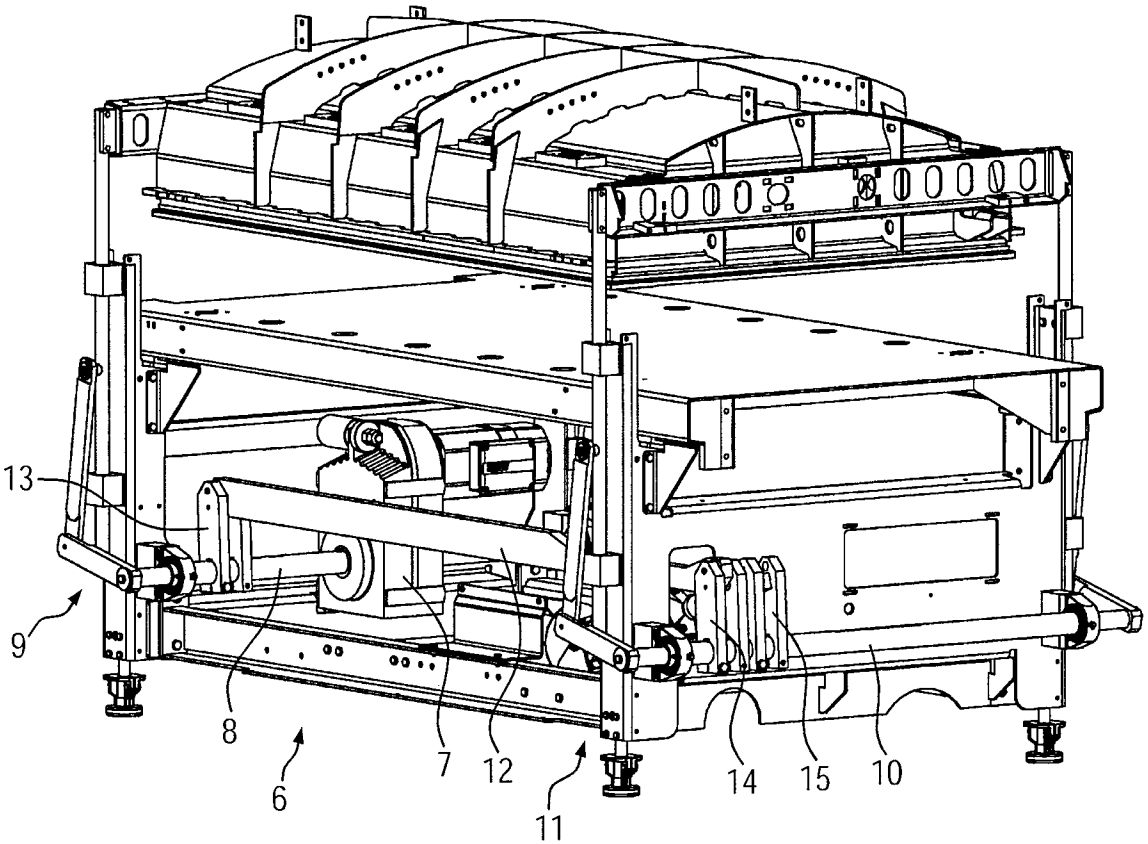
FIG. 2 is a perspective view of the device according to the present disclosure in the opened position.

FIG. 2 depicts the device 6 according to the present disclosure for lifting and lowering the chamber upper part 3. The motorized drive 7 drives the shaft 8 of the first lifting mechanism 9, which is arranged on the back side of the chamber upper part 3 seen in the conveying direction R and that lifts or lowers this side of the chamber upper part 3. The shaft 10 of the second lifting mechanism 11 on the front side of the chamber upper part 3 is coupled to the shaft 8 via the connection element 12, by means of two lever pairs 13 and 14 which are permanently connected to the shafts 8 and 10, respectively. This execution is suitable for being executed with freedom from play.

Figure 3:
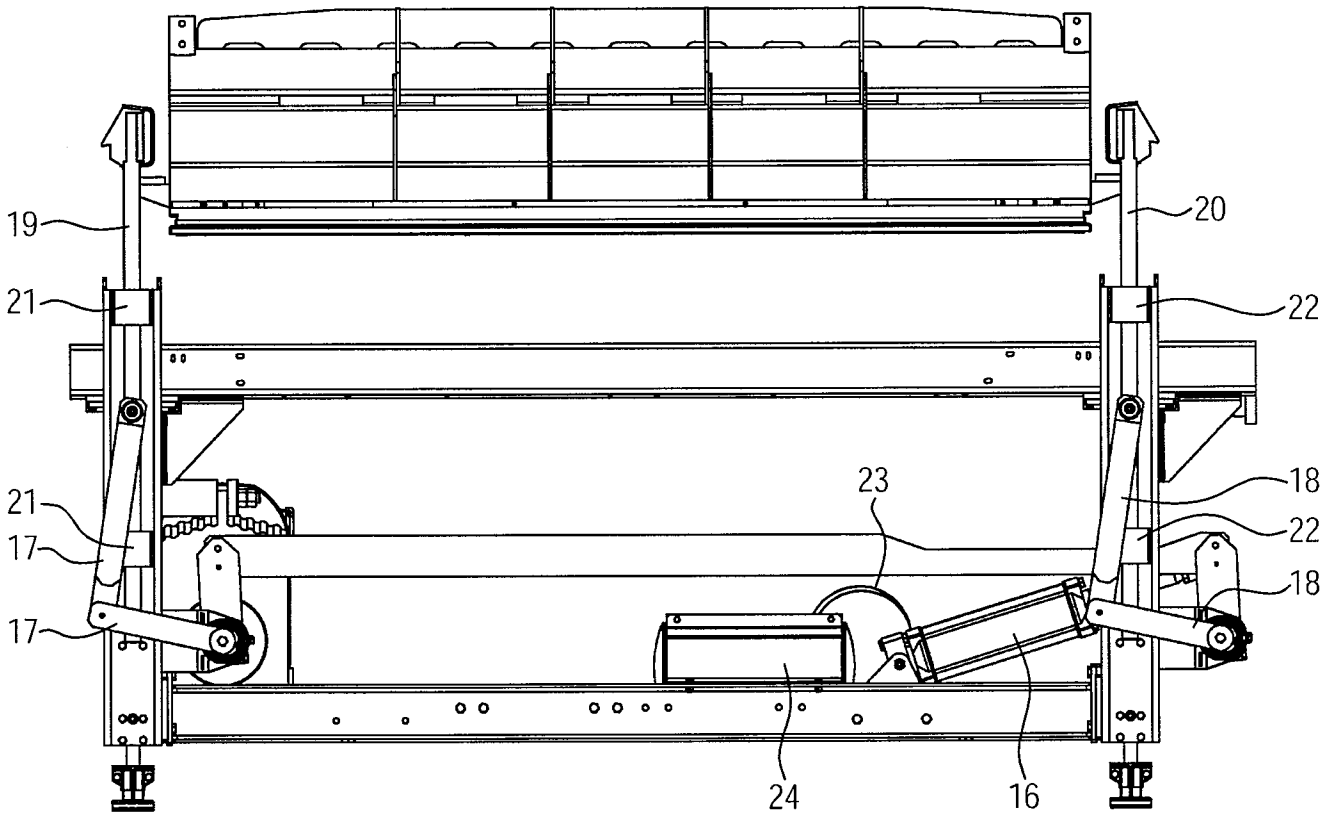
FIG. 3 is a side view of the device according to the present disclosure in the opened position.

The force application of an adjusting cylinder or pneumatic cylinder 16 is implemented on an additional lever pair 15, as shown in FIGS. 2 and 3, and the lever pair 15 is permanently attached to the shaft 10. The rotational movement of the shafts 8, 10 is converted into a vertical movement of the columns 19, 20 via the lever pairs 17 and 18, whereby the columns are run in the bearings 21, 22 in order to prevent tipping and twisting. The columns 19, 20 are connected to the chamber upper part 3 and consequently provide the up and down movement, while the chamber upper part 3 remains parallel to the machine table.

By means of the arrangement of the lever pairs 13, 14, 15, 17, 18, optimal coordination is made possible between the path of the movement, the movement profile (acceleration and speed) and the correspondingly arising forces and moments of torque of the motor and cylinder and the moved masses.

FIG. 3 also depicts the line 23 from the cylinder to the pressurizing agent container 24. At the beginning of production, the filling level or the pressure in the shared volume of the pressurizing agent container 24, line 23 and the proportion of the acting volume in the cylinder 16 can generate and influence the force ratio between the maximum force when the piston of the cylinder 16 is slid in and minimal force when the piston is slid out.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A device for moving a chamber upper part of a chamber conveyor belt machine, the device comprising:

a first lifting mechanism operably connected to the chamber upper part;

a motorized drive drivingly engaged with the first lifting mechanism for driving the first lifting mechanism;

a second lifting mechanism operably connected to the chamber upper part;

a connection element that couples the first lifting mechanism to the second lifting mechanism; and an adjusting cylinder acted upon by fluid, the adjusting cylinder being in operable engagement with the second lifting mechanism.

2. The device according to claim 1 wherein each lifting mechanism can be driven upward in a vertical direction.

3. The device according to claim 1 wherein air is provided as the fluid for the cylinder.

4. The device according to claim 1 further comprising a pressurizing agent container and a line that connects the pressurizing agent container to the cylinder.

5. The device according to claim 4 wherein fluid in the pressurizing agent container can be compressed by the cylinder during a lowering of the chamber upper part.

6. The device according to claim 4 wherein the fluid is provided in a closed system comprising the cylinder, the pressurizing agent container and the line.

7. The device according to claim 1 wherein the first lifting mechanism comprises a first shaft, the second lifting mechanism comprises a second shaft, and the connection element is configured to transfer a force or torque from the first shaft to the second shaft.

8. A method for moving a chamber upper part of a chamber conveyor belt machine, the method comprising:

driving a first lifting mechanism using a motorized drive, wherein the first lifting mechanism is coupled to the chamber upper part and is further coupled to a second lifting mechanism by a connection element; and driving the second lifting mechanism using a cylinder that is acted upon by fluid, wherein the cylinder and the motorized drive both drive the lifting of the chamber upper part.

9. The method according to claim 8 wherein movement of the first and second lifting mechanisms is synchronized by the connection element.

10. The method according to claim 8 wherein the cylinder is connected to a pressurizing agent container, and wherein when the chamber upper part is lifted, pressure in the pressurizing agent container is reduced and when the chamber upper part is lowered, the pressure in the pressurizing agent container is increased.

11. The method according to claim 8 wherein the second lifting mechanism is coupled to the chamber upper part.

12. A chamber machine comprising:

a chamber upper part that is movable between raised and lowered positions; and a device for moving the chamber upper part, the device comprising a first lifting mechanism connected to the chamber upper part, a motorized drive associated with the first lifting mechanism for driving the first lifting mechanism, a second lifting mechanism connected to the chamber upper part, a connection element that couples the first lifting mechanism to the second lifting mechanism, and an adjusting cylinder in operable engagement with the second lifting mechanism.

13. The chamber machine according to claim 12 wherein the first lifting mechanism comprises a first shaft, the second lifting mechanism comprises a second shaft, and the connection element is configured to transfer a force from the first shaft to the second shaft.

14. The chamber machine according to claim 12 further comprising a pressurizing agent container connected to the cylinder, wherein when the chamber upper part is moved toward the raised position, pressure in the pressurizing agent container is reduced, and when the chamber upper part is moved toward the lowered position, the pressure in the pressurizing agent container is increased.

15. The chamber machine according to claim 12 wherein movement of the first and second lifting mechanisms is synchronized by the connection element.

* * * * *